United States Patent [19]

Hadzicki

[11] Patent Number: 4,892,272

[45] Date of Patent: Jan. 9, 1990

[54] KITE-LIKE FLYING DEVICE WITH DUAL HANDLES AND FOUR POINT CONTROL

[76] Inventor: Joseph R. Hadzicki, 4489 Caminito Cuarzo, San Diego, Calif. 92117

[21] Appl. No.: 257,859

[22] Filed: Oct. 14, 1988

[51] Int. Cl.[4] ..... B64C 31/06

[52] U.S. Cl. ..... 244/153 R; 244/155 R; 244/155 A

[58] Field of Search ..... 244/153 R, 153 A, 155 A, 244/154, 155 R; D21/88; 446/30, 31, 32, 33

[56] References Cited

U.S. PATENT DOCUMENTS

| | | | |
|---|---|---|---|
| 2,388,478 | 0/0000 | Garber | 244/153 |
| 2,437,038 | 3/1948 | Nowka | 244/153 R |
| 2,472,075 | 6/1949 | Hole | 244/155 A |
| 2,546,078 | 3/1951 | Rogallo et al. | 244/153 |
| 2,751,172 | 6/1956 | Rogallo et al. | 244/153 |
| 2,839,259 | 6/1958 | Mayne | 244/155 A |
| 3,194,520 | 7/1988 | Kurkijian | 244/153 |
| 3,296,617 | 1/1967 | Rogallo | 343/18 |
| 3,310,261 | 3/1967 | Rogallo et al. | 244/44 |
| 3,338,536 | 8/1967 | Hull et al. | 244/155 A |
| 3,355,129 | 11/1967 | Kinsey | 244/155 A |
| 3,446,458 | 5/1969 | Rogallo | 244/43 |
| 3,746,286 | 7/1973 | Christoffel | 244/155 A |
| 3,892,375 | 7/1975 | Dunford | 244/153 R |
| 4,129,272 | 12/1978 | Jones et al. | 244/152 |
| 4,286,762 | 9/1981 | Prouty | 244/153 R |

FOREIGN PATENT DOCUMENTS

| | | | |
|---|---|---|---|
| 911223 | 7/1946 | France | 244/153 R |

OTHER PUBLICATIONS

"Kites", p. 135.

"The Man Who Invented the Flexible Wing, the Hang Glider & Succeeded in Mating a Jet with a Parachute," by Mary E. Ames, *American Kite*, Fall 1988, pp. 34–44.

"Target Kite Imitates Plane's Flight" by Authur Grahame, *Popular Science*, May, 1945, pp. 65–67.

*Primary Examiner*—Joseph F. Peters, Jr.
*Assistant Examiner*—Anne Sartelle
*Attorney, Agent, or Firm*—Nydegger & Harshman

[57] ABSTRACT

A preferred embodiment of the present invention includes a kite having a sail with a left and right wing, each being connected to a supporting frame, with the frame having a leading edge support member associated with a left wing strut member and with a right wing strut member. It also includes bridle associated with the frame, the bridle having a horizontal line member connected to the leading edge support member, a left wing vertical line member connected to the left wing vertical support member, and a right wing vertical line member connected to the right wing strut member. The horizontal line member is connected to the left and right wing vertical line members at upper left and upper right control line contact points. The set of control lines includes an upper left line and an upper right line connected to the upper left and upper right control line contact points. The set of control lines further includes a lower left line and a lower right line connected to a lower left and lower right control line points. A left control handle is connected to the upper left and lower left control lines, and the right control handle is connected to the upper right and lower right control lines. A venting screen is located along a leading edge of the sail. The control handle members include a design which mechanically amplifies the reverse flight signals relative to the forward flight control line signals.

9 Claims, 4 Drawing Sheets

KITE-LIKE FLYING DEVICE WITH DUAL HANDLES AND FOUR POINT CONTROL

BACKGROUND OF THE INVENTION

This invention relates generally to kite-like flying devices. More particularly, this invention relates to a kite-like flying device which is well suited to high performance controlled by four strings.

DESCRIPTION OF THE PRIOR ART

There have been many kite-like flying devices in the prior art which have been designed to exhibit high performance characteristics in terms of maneuverability, speed, and responsiveness to control signals from the user. In conventional prior art kites, attempts have been made utilizing two strings to control kites. Recent examples of this are disclosed in U.S. Pat. No. 4,286,762 for a kite-like flying device which utilizes two strings. Two strings are connected to a string harness attached at either end of the cross stick. The patent discloses that an operator may cause the kite to move from side to side, loop, dive, sweep, form figure eights, or perform other maneuvers. However, this device has its limitations in terms of its ability to perform such maneuvers and the required use of a control rod, which is an additional element of the device to allow its operation as disclosed in the patent.

There have also been attempts in the prior art for two-line controls of kite-like flying devices, to devise control devices which utilize complicated structures which alter the wing configuration to provide control. For example, in U.S. Pat. No. 3,446,458, there is disclosed a control device for a flexible wing aircraft. However, such devices are designed to allow the wing member configuration to be altered for flexible wing air vehicles. Because of the size and weight of these types of vehicles, such as gliders, powered drones, aircraft, and wings for the recovery of rocket boosters and space capsules, these types of devices are not practical and not well suited to high performance maneuverability.

Other conventional devices in the prior art are those shown in U.S. Pat. No. 3,296,617 for a target kite, and in U.S. Pat. No. 2,388,478 for a target kite also. In addition, there have been articles written outlining attempts to provide kites which are capable of responding to controls such as the article published in May, 1945, edition of *Popular Science*, and an article as disclosed in the Fall, 1988, issue of *American Kite* at pages 34 through 44. Again, such kites are designed to respond to controls from the ground level, and use of two strings. However, each of these devices is cumbersome to use, and did not permit many maneuvers for which the kite flyer of today desires to perform with the kite.

The prior art devices thus fail to provide total controllability of a kite-like flying device. Conventional kite-like flying devices cannot be made to easily perform various flying maneuvers including, but not limited to, left and right turns, continuous speed control, reverse flight, instantaneous stopping ability, and a turning radius limited only by the wingspan of the flying device. In addition, prior art kites cannot be flown in wind conditions ranging from extremely light to very heavy.

There are many potential stunts that are presently impossible for two line controlled kites. Unfortunately, current stunt flying competitions which utilize such prior art kites presently consist largely of left/right turning maneuvers. Thus, conventional prior art kites do not sufficiently challenge the kite flyer's skill and imagination.

SUMMARY OF THE INVENTION

It is an object of the present invention to provide a kite-like flying device which is capable of performing various flying maneuvers exhibiting a wide range of controllability.

It is a further object of the present invention to provide a kite-like flying device which is capable of left and right turns, continuous speed control, reverse flight, instantaneous stopping ability, and a turning radius limited only by the wing span of the flying device.

It is yet another object of the present invention to provide a kite-like flying device which is easy to use and is reliable.

It is yet another object of the present invention to provide a kite-like flying device and method of operating same which is simple and efficient to manufacture and use.

Further objects of the present invention will become apparent in the full description of the invention taken in conjunction with the drawings as set forth below.

A preferred embodiment of the present invention includes a kite having a sail with a left and right wing, each being connected to a supporting frame, with the frame having a leading edge support member associated with a left wing strut member and with a right wing strut member. It also includes bridle associated with the frame, the bridle means having a horizontal line member connected to the leading edge support member, a left wing vertical line member connected to the left wing vertical support member, and a right wing vertical line member connected to the right wing vertical support member. The horizontal line member is connected to the left and right wing vertical line members at upper left and upper right control line contact points. The set of control lines includes an upper left line and an upper right line connected to the upper left and upper right control line contact points. The set of control lines further includes a lower left line and a lower right line connected to a lower left and lower right control line points. A left control handle is connected to the upper left and lower left control lines, and the right control handle is connected to the upper right and lower right control lines. A venting screen is located along a leading edge of the sail. The control handle members include a design which mechanically amplifies the reverse flight signals relative to the forward flight control line signals.

DESCRIPTION OF A PREFERRED EMBODIMENT

Figure 1:
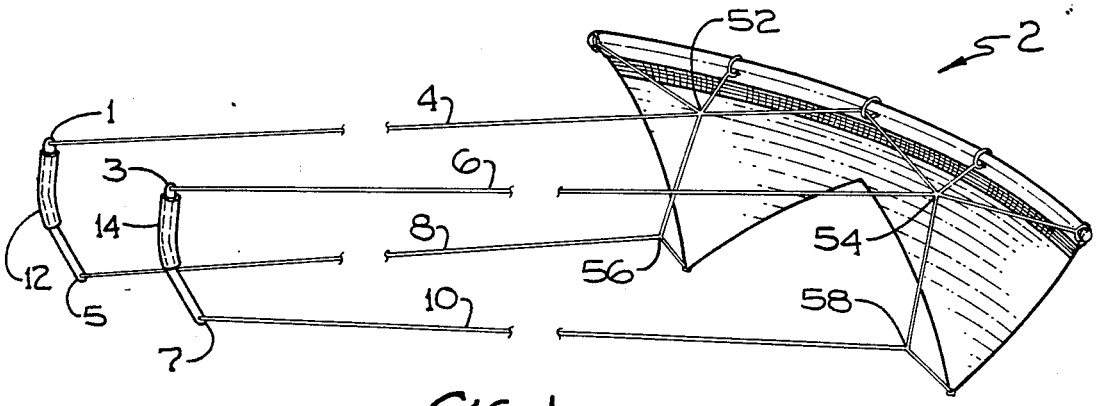
FIG. 1 is a perspective view of a preferred device according to the invention while in flight.

As shown in FIG. 1, a preferred embodiment of the invention includes a kite assembly 2, control strings 4, 6, 8, and 10, and left and right control handles 12, and 14.

Figure 2:
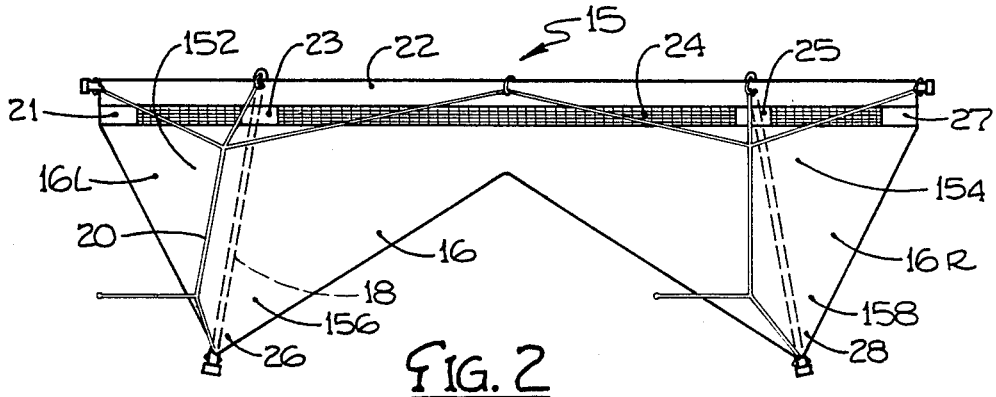
FIG. 2 shows a preferrd embodiment of the kite assembly portion of the invention.

The kite assembly 2, shown in FIG. 2, comprises a sail assembly 15, skeletal structure 18, and harnessing bridle 20.

The sail assembly 15 includes of a leading edge sleeve 22, of lightweight, flexible sheet material, such as resin-impregnated Dacron Polyester fabric, a venting screen 24, made of a suitable flexible porous material which allows air to easily pass through, such as plastic-coated fiberglass mesh, and a double-V-shaped sail 16, of suitable lightweight flexible sheet material, such as resin-impregnated ripstop Nylon fabric. The sail 16 has a left wing portion 16L and a right wing portion 16R. The high-stress points of the venting screen 24, and lower wingtip portions 26 and 28, are reinforced using panels 21, 23, 25, and 27, of stronger sheet material such as resin-impregnated Dacron fabric.

Figure 3:
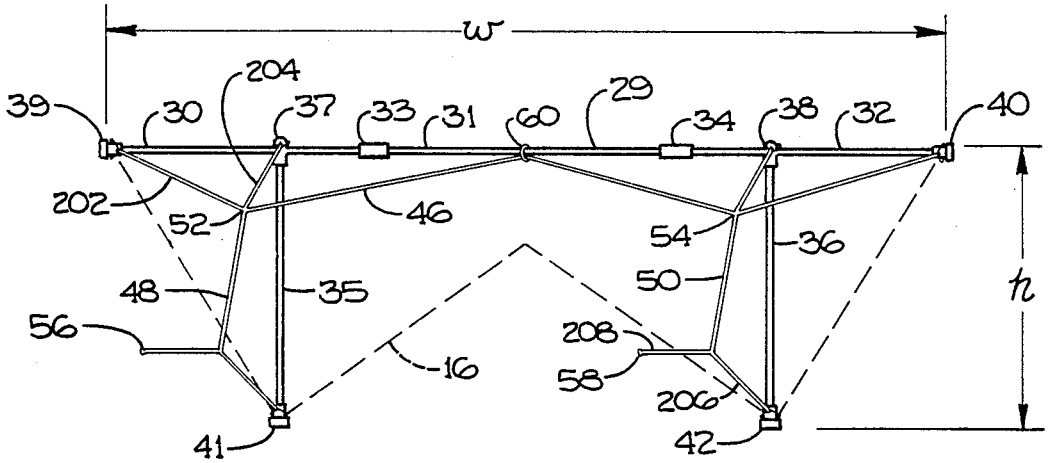
FIG. 3 shows a preferred skeletal structure assembly and harnessing bridle.

Referring now to FIG. 3, there is shown the skeletal structure having leading edge support member 29. In the embodiment shown, it comprises tubular members 30, 31, and 32 joined by joint members 33 and 34. Connected to the support member 29 is a left wing strut member 35 and a right wing strut member 36. They are held in place by means of left and right wing strut connecting assemblies 37 and 38 coupled to leading edge support member 29, and end-plug assemblies 39, 40, 41, and 42 fixed to respective edges of sail 16.

The tubular members 30, 31, 32, constituting the leading edge support member 29, and struts 35 and 36 constituting the skeletal structure, are made of a lightweight and strong yet resilient material, such as graphite/S-glass composite reinforced plastic tube. The horizontal length w of leading edge support member 29 is approximately three times that of the height h of the struts 35, 36. A preferred dimension that works well is 9 feet wide, and 3 feet high, kite-like device.

Figure 4:
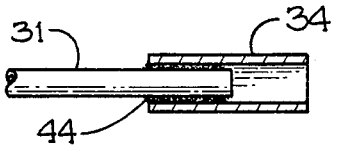
FIGS. 4 and 5 are sectional views of a preferred construction for the leading edge support structure.
Figure 5:
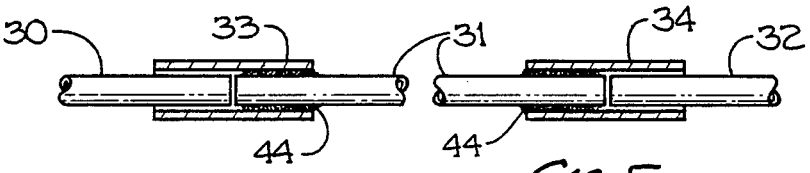

FIGS. 4 and 5 show the connecting method employed at the leading edge splicing joints 33 and 34. The splicing elements 33 and 34 are fabricated from aluminum tubing with an inside diameter sufficiently large enough to allow a sliding fit of the tubular skeletal members. The splicing elements 33 and 34 are joined to both ends of the central leading edge tubular member 31 using an epoxy adhesive 44 s shown in FIG. 5. This allows tubular member 30 to slide into the splicing element 33 and tubular member 32 to slide into splicing element 34.

Figure 6:
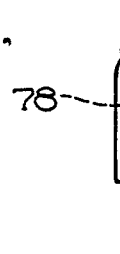
FIGS. 6 and 7 show a preferred embodiment and sectional view of the wing strut cap assembly.
Figure 7:
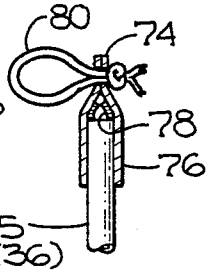

In FIGS. 6 and 7 the wing strut members 35 and 36 are slidably connected at the leading edge of the kite using wing strut connecting members 37 and 38. FIG. 6 shows a frontal view one of the wing strut connecting members 37, and which has the same construction as the other wing strut connecting member 38. The wing strut connecting member 37 comprises a wing strut cap 76 formed from a small section of aluminum tubing. The top edge of the wing strut cap 76 is crimped and has a hole 75 through it. FIG. 7 shows a cross-section of the wing strut cap 76. Inside the aluminum tube of the wing strut cap 76 is a small shock absorbing element 78, such as a piece of polyvinyl tubing. The wing strut 35 fits into the open ends of the wing strut caps 76 and rests against the shock absorbing element of polyvinyl tubing 78. A loop of cord 80, such as Nylon, passes through the wing strut cap hole 75 and is attached by encircling the leading edge support member 29 directly above the reinforcement panels 23 and 25. Wing strut 36 is likewise similarly connected. Thus it can be appreciated that rather than rigid attachment there is total freedom of movement between the leading edge support member 29, and the wing struts 35, 36.

Figure 8:
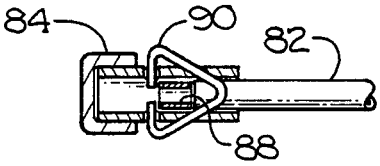
FIG. 8 is a sectional view of an end plug assembly.

FIG. 8 shows an end plug assembly employed at 39, 40, 41, and 42 (FIG. 3). The end plug assembly has a number of purposes. It is used to attach the sail assembly 16 to the skeletal structure. Another purpose is to protect the ends of the tubular structural members upon impact. Finally, it helps to prevent injury in case of accidental impact. The end plug is made of a section of tubing 82. At one end of the tube is a rubber cap 84. The other end of the tube is open to accept the slide-fitting structural tubular members 30, 32, 35, and 36 which rest against a small section of polyvinyl tubing 88, which acts as a shock absorbing element. A triangular clip 90 is inserted and compressed into holes through the end plug 82.

Figure 9:
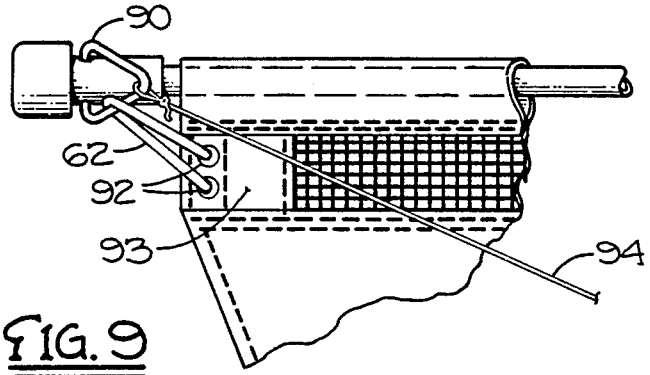
FIG. 9 shows the left wingtip area including end plug connecting members.

As shown in FIG. 9, an elastic cord 62 forms a loop which passes through the triangular clip 90, and the two holes 92 in the reinforcement panel 93. FIG. 9 also shows the typical bridle attachment method. Bridle line 94 is typical of the horizontal and vertical bridal line attachments made at end plug assemblies 39, 40, 41, and 42.

FIG. 3 further shows the bridle arrangement made of strong line, such as high-test braided Dacron line. The bridle arrangement consists of horizontal bridle line member 46 and vertical bridle line members 48 and 50. The horizontal bridle line 46 is anchored at the end plug assemblies 39 and 40 as shown in FIG. 9. The center part of the horizontal bridle line passes through the midpoint 60 of the leading edge sleeve 22, and encircles the tubular member 31. The upper end of the vertical bridle lines 48 and 50 are connected to the cord loop 80 of the wing strut connecting members 37 and 38. The lower ends of the vertical bridle lines are attached to the end plugs in the conventional manner (See FIG. 9). The horizontal line 46 and vertical lines 48 and 50 intersect near the leading edge at upper left and right control line contact points 52 and 54, respectively. The lower left and right control line contact points 56 and 58 are adjustably located near the lower wing tip end plugs 41 and 42. Positioning of bridle control points 52, 54 is critical since horizontal placement toward the center of the kite causes a loss of control and sensitivity. Conversely, horizontal placement away from the center of the kite tends to cause excessive flexing of the leading edge structure.

One set of bridle line adjustments that has been found to work well for a kite having a wingspan w of about 9 feet, is one having an outside bridle line 202 of about 24½ inches, inside bridle line 46 of about 31 inches to the center 60, an upper vertical line 204 of about 9½ inches, a center section vertical line 50 of about 25½ inches, and lower section vertical line 206 of about 10 inches, and a lower extension line 208 of about 10 inches. The same relative dimensions would be scaled accordingly if the device were larger or smaller than that disclosed, to maintain this relationship in this particular embodiment.

As further shown in FIGS. 1 and 2, the extreme ends of the control lines 4, 6, 8, and 10 are attached to the kite at the contact points 52, 54, 56, and 58, and to the control handles 12 and 14 at points 1, 3, 5, and 7, respectively. The four lines allow the controller to affect the angular relationship between four sections (upper left wing 152, lower left wing 156, upper right wing 154, lower right wing 158) of the sail surface 16. This in turn affects wind flow patterns causing left, right, fore, and aft pitching motions, which allow the kite to maneuver at any speed, in any direction of the hemispherical flight path.

The importance of the handles shown in FIG. 1, is their ability to incline and decline their respective sail surfaces. The left handle controls the inclination/declination of the left wing portion of the sail 16 while the right handle controls the inclination/declination of the right wing portion of the sail 16.

Figure 11:
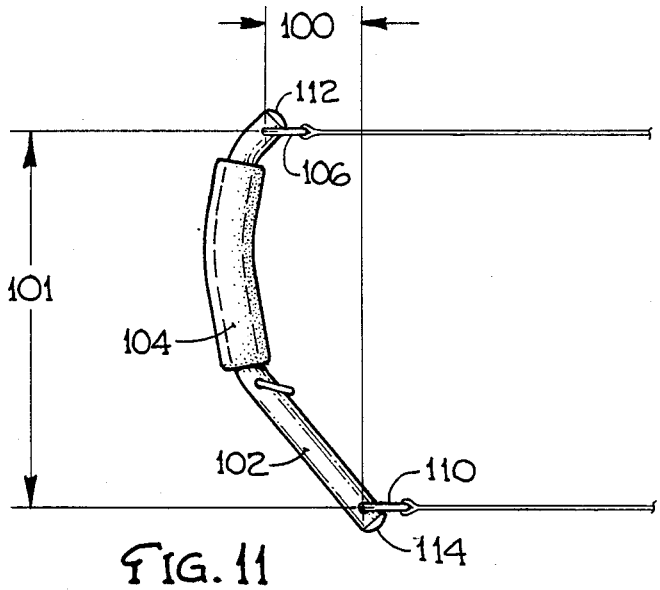
FIG. 11 shows a preferred embodiment of the control handle.

FIG. 11 shows in detail a typical control handle design, including handle structure 102, manufactured from a rigid material such as aluminum tubing, foam rubber handle grip 104, triangular connector clips 106, and 110, and rubber end plugs 112 and 114.

A typical range for the horizontal dimension 100, ranges approximately from one inch to five inches, while the vertical dimension 101, may range from approximately four inches to nine inches.

Figure 14:
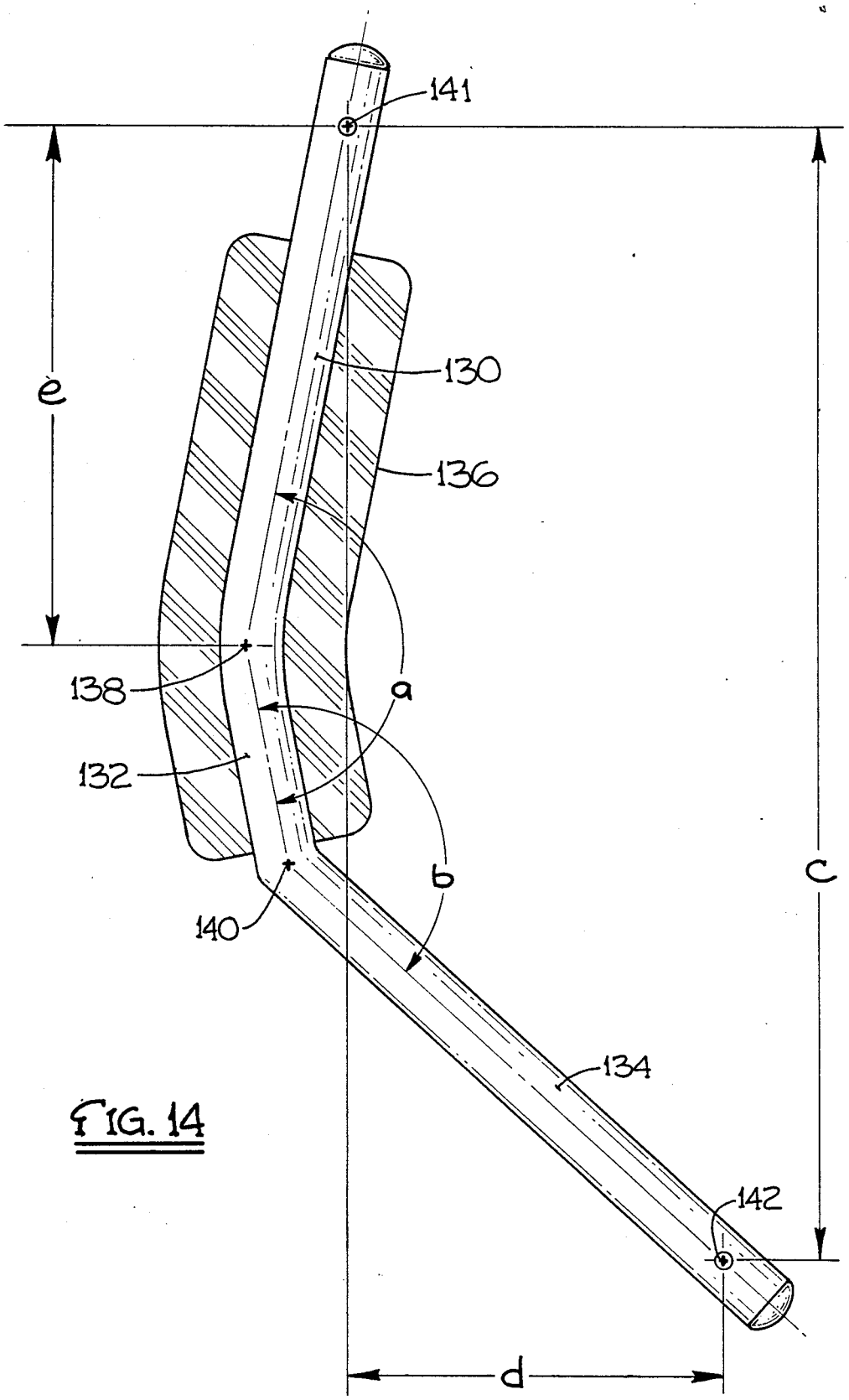
FIG. 14 is a side view of an embodiment of the control handles in accordance with the present invention.

FIG. 14 shows in additional detail a preferred control handle design, the handle having top portion 130, center portion 132, and bottom portion 134, covered by soft handle covering 136. Handle portions 130 and 132 are connected at point 138 to form an angle of about 158 degrees. Handle portions 132 and 134 are connected at point 139 to form an angle b of about 143 degrees. The vertical distance c between the top and bottom line contact points 141, 142 of the handle is about 9 inches, and the horizontal distance d between the top and bottom line contact points 141, 142 is about one-third this distance, i.e., 3 inches. The vertical distance between top line contact point 141 and point 138 about which the user's hand would pivot, is about 4.125 inches. These relative relationships appear to give the appropriate amount of amplification to the control signal as mentioned further herein.

Figure 12:
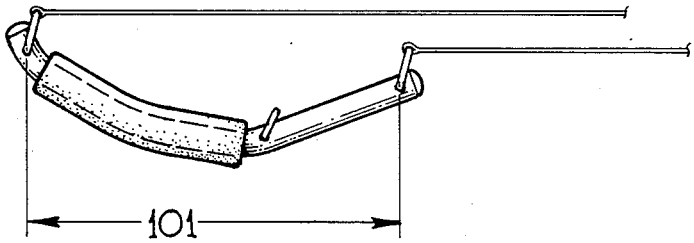
FIGS. 12 and 13 show control handle positions during full-forward control signal, and full-reverse control signal, respectively.
Figure 13:
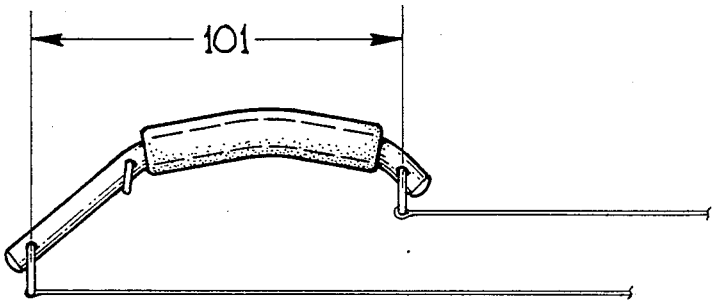

A very important characteristic of the control handle device is its capability to produce stable reverse flight. Due to the unique handle design, reversing control signals are mechanically amplified relative to forward control signals. Consider the control handle position of FIG. 11 which produces a steady forward flight pattern in which the relative signal between upper and lower control points 106 and 110 is zero. By rotating the handle backward to the full forward position shown in FIG. 12, the relative signal between the upper and lower control points is now the distance 101 minus the initial position of FIG. 11, which was distance 100. Therefore, the relative difference between the initial position of FIG. 11 and the full-forward position of FIG. 12 is distance 101 minus distance 100. Now consider a full-reverse signal shown in FIG. 13. The relative difference between the initial position shown in FIG. 11 and the full-reverse position shown in FIG. 13 is distance 101 plus distance 100. In practice, this amplification of the reversing signal is sufficient to produce instantaneous stopping from forward flight velocities in excess of 50 miles per hour. The reversing amplification also allows reverse flight during any point in the flight cycle including, but not limited to reverse lift-off from the ground, with the kite initially in a nose-down position. Sensitivity adjustments can be made by adjusting the lower bridle control line contact points 56 and 58 shown in FIG. 3.

Figure 10:
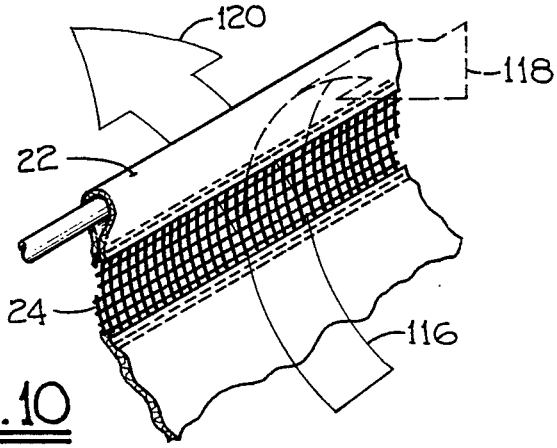
FIG. 10 is a diagrammatic representation of air-flow characteristics of a vented and unvented leading edge during reverse flight conditions.

FIG. 10 exemplifies the airflow characteristics occurring at the leading edge during reverse flight conditions. The purpose of the venting screen 24 is to vent airflow during reverse flight and during tight-turning-radius maneuvers. In reverse flight, the relative air motion 116, is from the aft portion of the sail toward the leading edge 22. In the absence of the venting screen, under the reverse flight conditions, an air pocket is formed in the sail at the leading edge which acts as an air-breaking mechanism, which causes the airflow to backup 18. By venting the leading edge area of the induced air pocket, the air-breaking action is significantly reduced by allowing a large portion of the airflow 120 to continue through the restrictive leading edge area. This in turn greatly improves the reverse flight characteristics of the device.

Secondly, this venting improves the turning characteristics of the kite. A turn is produced when the leading wing of the sail flies faster relative to the trailing wing of the sail. This occurs when the leading wing portion experiences greater lift than the trailing wing portion. By reducing the trailing wing air speed to zero, the trailing wingtip becomes the center of rotation. On presently available flying devices, the above conditions represent the tightest turn radius possible. In other words, the minimum turn radius attainable in presently available stunt kites is a radius of one wing span. By venting the sail, the turn can be optimized by zeroing and then reversing the flight direction of the trailing wing. The turn radius is reduced to one-half of one wingspan, producing a controlled propeller-like spinning action, heretofore unheard of in the prior art.

It may be appreciated by those skilled in the art that the vertical support members 35, 36, described as struts, could also be any suitable framework which performs the same function of a brace fitted into the skeletal structure to allow the sail to resist pressure.

Although the present invention has been shown and described in terms of specific preferred embodiments, it will be appreciated by those skilled in the art that changes or modifications are possible which do not depart from the inventive concepts described and taught herein. Such changes and modifications are deemed to fall within the purview of these inventive concepts. Thus, it should be noted that the accompanying description and drawings are meant to describe the preferred embodiments of the invention, but are not intended to limit the spirit and scope thereof.

I claim:

1. A kite, comprising:

a substantially double V shaped sail having a left wing and a right wing each connected to a supporting frame, said frame having a leading edge support member associated with a left wing strut member and with a right wing strut member;

bridle means associated with said frame, said bridle means having a horizontal line member connected to said leading edge support member, a left wing vertical line member connected to said left wing strut member, and a right wing vertical line member connected to said right wing strut member; and a set of control lines connected to said bridle, said set of control lines including an upper left line and a lower left line connected to upper left and lower left control line contact points, for controlling inclination of said left wing, respectively, and an upper right line and lower right line connected to upper right and lower right control line contact points, respectively, for separately controlling inclination of said right wing.

2. The kite of claim 1, wherein said horizontal line member is connected to said left and right wing vertical line members at upper left and upper right control line contact points, respectively.

3. The kite of claim 2, further comprising a left control handle member connected to said upper left and lower left control lines and a right control handle member connected to said upper right and lower right control lines.

4. The kite of claim 3, wherein said control handle members include means for mechanically amplifying reverse flight control line signals relative to forward flight control line signals.

5. The kite of claim 1, wherein said sail further comprises a vented screen portion located adjacent the leading edge of said sail.

6. A kite-like flying device having a double V shaped sail connected to a supporting frame, the supporting frame including a leading edge support member connected to left and right vertical struts, each said strut positioned generally to longitudinally bisect each said V shape, said sail having upper and lower left wing portions, and upper and lower right wing portions, said device further comprising bridle means for connecting two control lines to said upper and lower left wing portions, and two control lines to said upper and lower right wing portions, respectively, said sail further including a vented screen portion adjacent said leading edge support member.

7. A kite-like flying device comprising a sail connected to a supporting frame, said sail having less surface area at the center than at its outer portions, said outer said portions including a left wing portion and a right wing portion and four control line contact points connected to said upper and lower portions of said left and right wing portions, respectively; and a left control handle adapted to be connected via control lines to said upper and lower left contact points, and a right control handle adapted to be connected via control lines to said upper and lower right contact points, wherein said control handles each have a top, central, and bottom portion, said top and central portions forming an angle between them of about 158 degrees and said central and bottom portions forming an angle between them of about 143 degrees, said left wing portion being movable to an angle of inclination different from that of said right wing portion in response to controlled movement of said control line contact points.

8. A kite-like flying device comprising a sail connected to a supporting frame, said sail having less surface area at the center than at its outer portions, said outer sail portions including a left wing portion and a right wing portion and four control line contact points connected to said upper and lower portions of said left and right wing portions, respectively; and a left control handle adapted to be connected via control lines to said upper and lower left contact points, and a right control handle adapted to be connected via control lines to said upper and lower right contact points, wherein said control handle has an upper line handle contact point and lower line handle contact point, and wherein the horizontal distance between said handle contact points is approximately one third the vertical distance between them, said left wing portion being movable to an angle of inclination different from that of said right wing portion in response to controlled movement of said control line contact points.

9. The device of claim 8, wherein said control handle has a pivot point located at the intersection of said top and central portions which is approximately one-half said vertical distance.

* * * * *